US008852031B2

(12) United States Patent
Williams, Sr.

(10) Patent No.: US 8,852,031 B2
(45) Date of Patent: Oct. 7, 2014

(54) TRAINING HARNESS FOR A BASKETBALL DEFENDER

(71) Applicant: Raynard Williams, Sr., Detroit, MI (US)

(72) Inventor: Raynard Williams, Sr., Detroit, MI (US)

( * ) Notice: Subject to any disclaimer, the term of this patent is extended or adjusted under 35 U.S.C. 154(b) by 210 days.

(21) Appl. No.: 13/622,643

(22) Filed: Sep. 19, 2012

(65) Prior Publication Data

US 2013/0072328 A1 Mar. 21, 2013

Related U.S. Application Data

(60) Provisional application No. 61/536,850, filed on Sep. 20, 2011.

(51) Int. Cl.
*A63B 69/00* (2006.01)

(52) U.S. Cl.
CPC ..... *A63B 69/0071* (2013.01); *A63B 2209/10* (2013.01)
USPC ..... 473/450

(58) Field of Classification Search
USPC ..... 473/450, 415, 446, 63; D24/192
See application file for complete search history.

(56) References Cited

U.S. PATENT DOCUMENTS

| | | | | |
|---|---|---|---|---|
| 1,937,571 | A * | 12/1933 | Hueneburg | 248/263 |
| 3,820,763 | A | 6/1974 | Caveness | |
| 3,858,881 | A | 1/1975 | Hurwitz | |
| 4,383,685 | A | 5/1983 | Bishop | |
| 4,579,341 | A * | 4/1986 | Furr | 473/450 |
| 4,605,227 | A | 8/1986 | Hurd et al. | |
| 4,984,789 | A | 1/1991 | Socci | |
| 5,002,273 | A | 3/1991 | Sela | |
| 5,228,682 | A | 7/1993 | Wolf | |
| 5,271,617 | A | 12/1993 | Gilford | |
| 5,324,026 | A | 6/1994 | Conlon et al. | |
| 5,437,619 | A | 8/1995 | Malewicz et al. | |
| 5,529,229 | A * | 6/1996 | Fier | 224/153 |
| 5,800,291 | A | 9/1998 | Grover | |
| 5,865,695 | A * | 2/1999 | Mahala et al. | 473/450 |
| 6,612,845 | B1 | 9/2003 | Macri et al. | |
| 7,172,522 | B1 | 2/2007 | Harvey | |
| 7,658,689 | B2 | 2/2010 | Crook, II | |
| 7,854,692 | B2 | 12/2010 | Prstojevich et al. | |
| 7,946,967 | B2 | 5/2011 | Berhanu | |
| 7,955,082 | B1 | 6/2011 | Gause | |
| 8,277,340 | B1 | 10/2012 | Devine | |
| 8,292,761 | B2 | 10/2012 | Krawczyk | |
| 8,323,126 | B1 | 12/2012 | Lozier | |
| 2002/0121742 | A1 | 9/2002 | Stauber | |

(Continued)

*Primary Examiner* — Gene Kim
*Assistant Examiner* — M Chambers
(74) *Attorney, Agent, or Firm* — Gifford, Krass, Sprinkle, Anderson & Citkowski, P.C.; Douglas J. McEvoy

(57) ABSTRACT

A wearable training harness for dissuading the committing of reach in fouls and including a looped belt adapted to be worn about a waist of a wearer, from which an upwardly extending suspender includes a first portion extending from a rear midpoint of the belt. A pair of second portions branches from the first portion and is adapted to extend over shoulder locations of the wearer, the second portions connecting at opposite lower ends to forward locations of the belt. A pair of elongate linkages are pivotally secured to a rigid planar member supported at a location associated with the first suspender portion. A pair of circular bands are adapted to be worn about the arms of the wearer, the bands pivotally secured to remote extending ends of the linkages.

19 Claims, 9 Drawing Sheets

(56) References Cited * cited by examiner

U.S. PATENT DOCUMENTS

| | | | | |
|---|---|---|---|---|
| 2009/0098955 | A1 | 4/2009 | Crook, II | |
| 2012/0208660 | A1 | 8/2012 | Mayers | |
| 2012/0270686 | A1 | 10/2012 | Sparks | |
| 2013/0072328 | A1 * | 3/2013 | Williams, Sr. | 473/450 |

TRAINING HARNESS FOR A BASKETBALL DEFENDER

CROSS REFERENCE TO RELATED APPLICATIONS

The present application claims the priority of U.S. Ser. No. 61/536,850 filed Sep. 20, 2011.

FIELD OF THE INVENTION

The present invention relates generally to a sports training device. More specifically, the present invention discloses a wearable harness with adjustable linkage worn by a basketball player in defender mode and in order to train against such as reach in fouls.

DESCRIPTION OF THE RELEVANT ART

The prior art depicts a number of basketball training aids, such as which are intended to assist in the development of basic player skills. A disproportionate number of these aids and training devices have been found to assist in the development of offensive layer skills only.

As to the instructing basketball defense, one example from the prior art includes the ultimate defender in Crook, II US Pub. No. 2009/0098955 which teaches a life size and repositionable mannequin style device for impersonating a defender and which includes adjustable torso and upper arm locations. Additional references include such as the basketball training apparatus disclosed in Grover, U.S. Pat. No. 5,800,291 which teaches a floor mounted apparatus with extending shot obstructing guarding mechanisms which are transversely movable by an operator (see at FIG. 11).

Sela, U.S. Pat. No. 5,002,273 teaches a tether type training device for training a defender to follow closely behind a ball carrier. A similar type of reaction training belt utilized in training drills is depicted in Prstojevich, U.S. Pat. No. 7,854,692 and which varies a release resistance at a connection established between tethered ends of first and second belt sub-portions respectively looped around first and second training participants.

SUMMARY OF THE PRESENT INVENTION

The present invention is a wearable training harness for dissuading the committing of reach in fouls and including a looped belt adapted to be worn about a waist of a wearer, from which an upwardly extending suspender includes a first portion extending from a rear midpoint of the belt. A pair of second portions branches from the first portion and is adapted to extend over shoulder locations of the wearer, the second portions connecting at opposite lower ends to forward locations of the belt.

A pair of elongate linkages are pivotally secured to a rigid planar member supported at a location associated with the first suspender portion. A pair of circular bands are adapted to be worn about the arms of the wearer, the bands pivotally secured to remote extending ends of the linkages.

Additional features include cushioning shoulder pads associated with uppermost extending locations of the second suspender portions. Each of the belt, first suspender portion, second pair of suspender portions, and arm bands are further capable of being length adjustable. In one non-limiting instance, this can include either or both of hook and loop fastener engageable portions, an elastic section located in the front for the shoulder straps, or buckle and snap engagement locations integrated into the second forward belt connecting portions of the over shoulder straps.

Also, the hook and loop fasteners can extend from a lower location of the first suspender portion for capturing the linkages during storage. The linkages each further include an inner linkage member pivotally secured at a first end to the rigid planar member, an outer linkage member is telescopically received over an end of each of the first linkage members. Elongated slots are defined along each of the outer linkage members, with sliding pins extending from end locations of the inner linkage members through the slots for defining an extensible range for the linkages.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
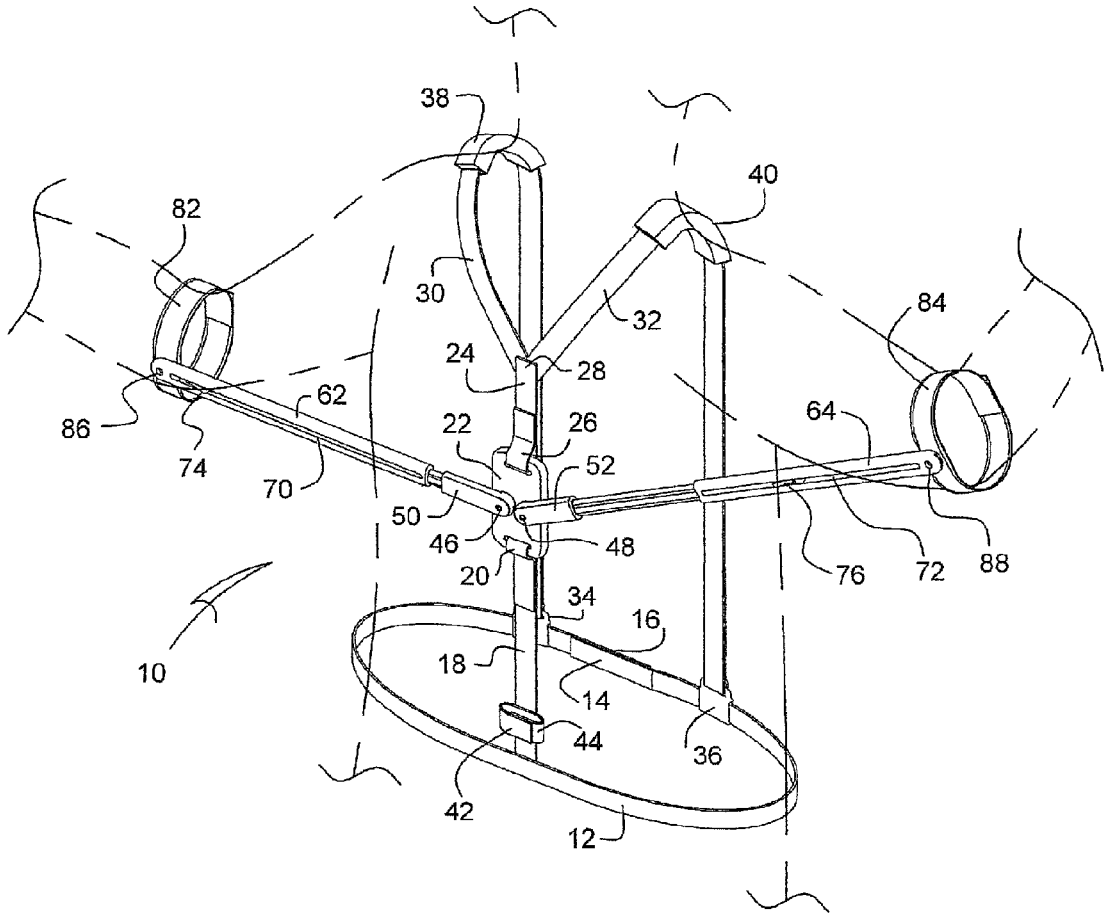
FIG. 1 is an environmental view of a player in rear perspective phantom and upon whom is attached the training harness with adjustable linkages.

Referring to the several illustrations, the present invention discloses a wearable harness with adjustable linkages, generally depicted at 10 in FIG. 1, and which is worn by a basketball player in defender mode (further shown in phantom in FIG. 1) and in order to train against such as reach in fouls. As will be further described in detail throughout the succeeding illustrations, the harness includes a series of links, straps and bands, with a unique slotted and pivoting arrangement permitting ranges of desired (two dimensional) vertical motion with concurrent increase in resistance when vector forces are redirected in a forward horizontal (three dimensional) direction, this assisting in developing proper basketball defensive techniques and which is a useful tool to assist the proper drilling and instruction of the player.

Unless otherwise specifically indicated, the material construction of the various components associated with the wearable training harness includes a plurality of flexible bands (each of these including any suitable natural or inorganic material) including a looped wearable belt and upwardly extending suspender, combined with arm location engaging bands. A pair of pivotal and extensible linkages (such as a lightweight metal but also contemplating a rigid, heavy duty nylon or other polymer based material) are further disclosed and which pivotally connect at first interior locations to a likewise rigid and planar supporting portion associated with a rear location of the wearable suspender. The linkages further extend, at respective and remote end locations, in pivotally engaging fashion to the arm engaging bands.

Figure 3:
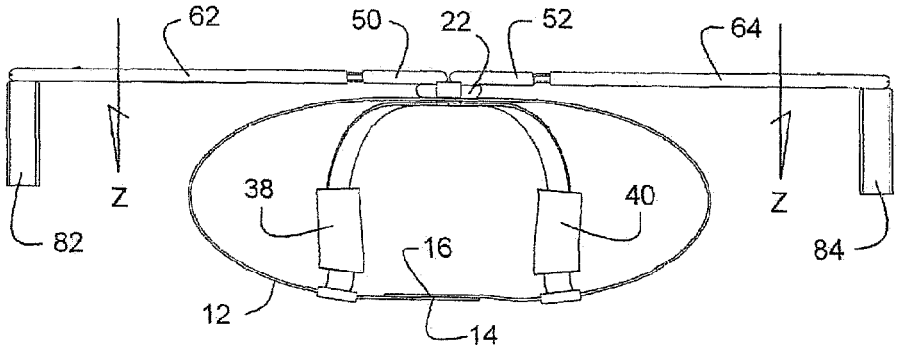
FIG. 3 is a top view of the training harness.
Figure 4:
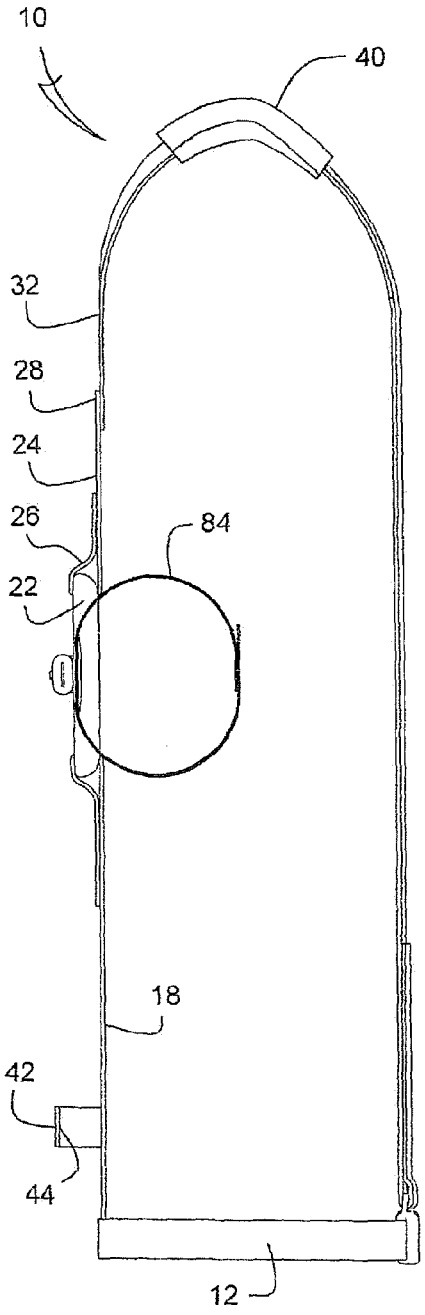
FIG. 4 is a right side view of the training harness.
Figure 5:
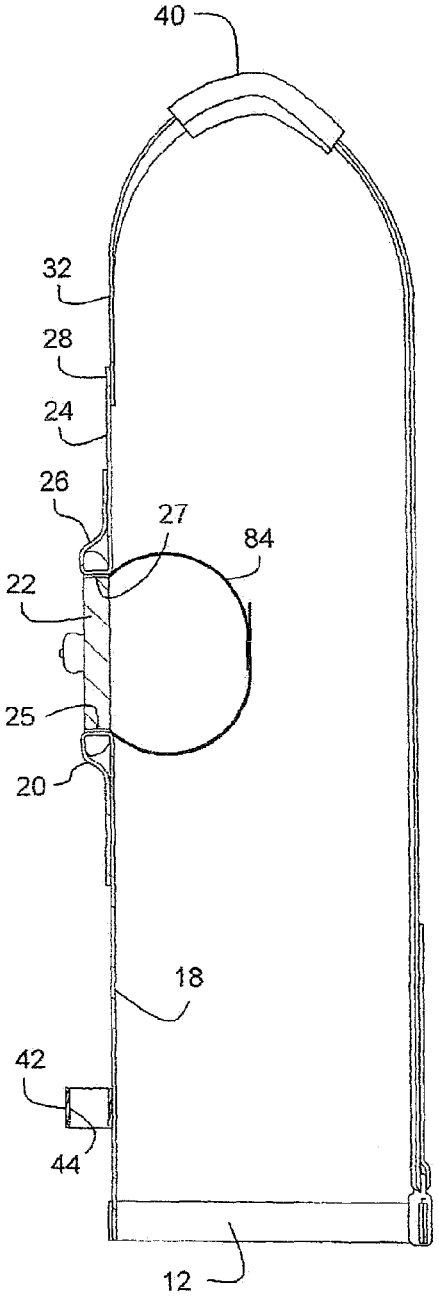
FIG. 5 is a cutaway view taken along line 5-5 of FIG. 2 down a centerline of the training harness.
Figure 12:
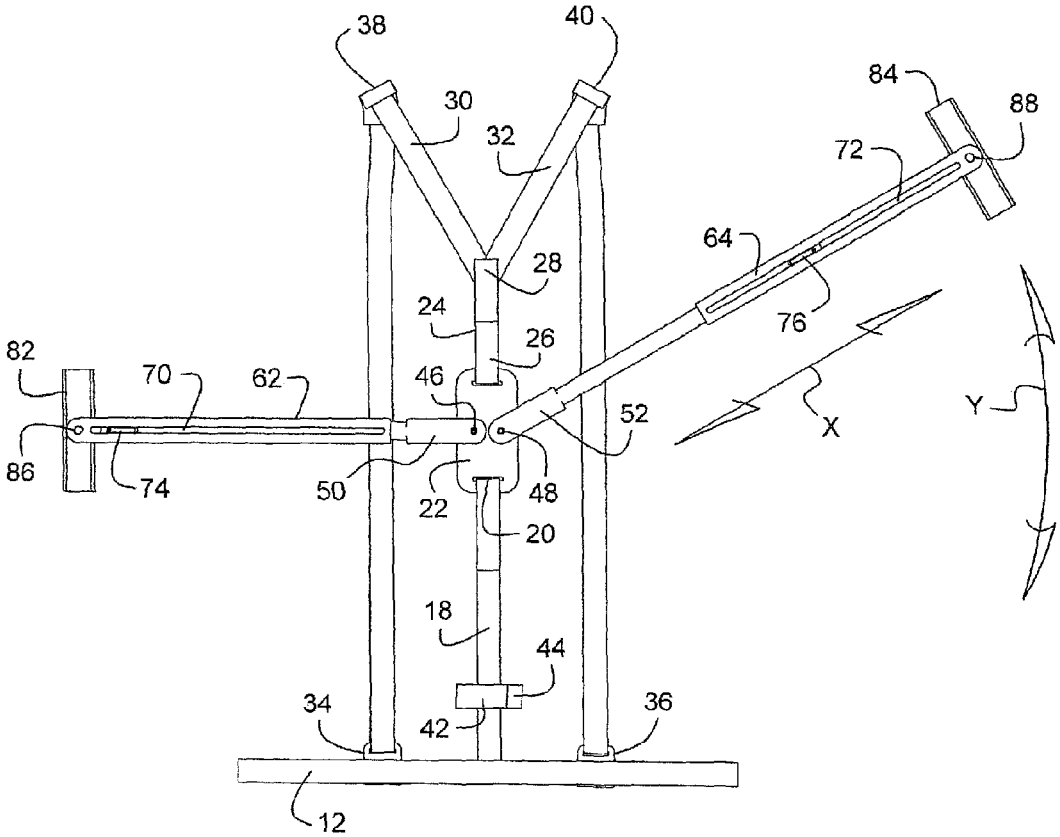
FIG. 12 is an illustration similar to FIG. 2 of a selected linkage assembly in a pivotally displaced position.
Figure 13:
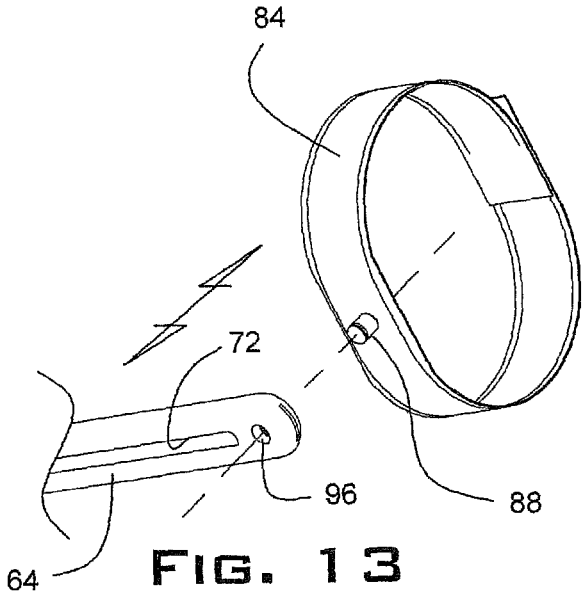
FIG. 13 is an exploded illustration of an arm support loop and end linkage attachment.
Figure 14:
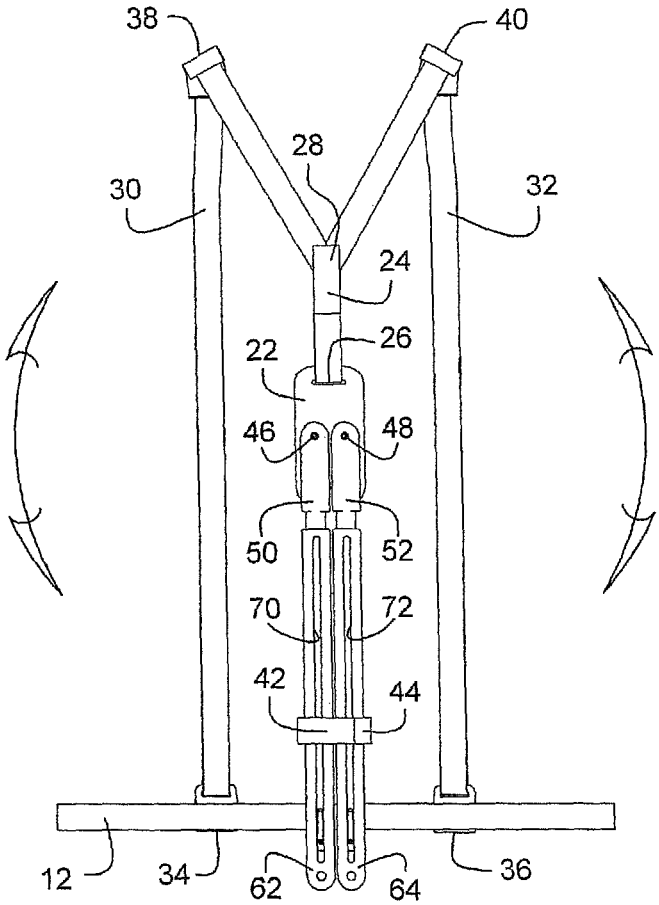
FIG. 14 is a plan view similar to FIG. 2 depicting the linkage assemblies in downward rotated storage positions and which are secured by hook and loop fastener portions.

In this fashion, the harness assembly 10 is configured such that, when worn by a player in a defensive mode, two dimensional (xy axis) motion of the players arms, this representing up/down (y) and sideways (x) directions as clearly shown in FIG. 12, is permitted and as is typical of the player in a defending position. The structure of the harness assembly is further such that it provides any degree of resistance to forward third dimensional (or z axis as referenced by directional arrow in FIG. 3) motion exerted by the wearer towards the offensive player, such as which can result in the calling of reach in or other fouls during a basketball contest.

Figure 2:
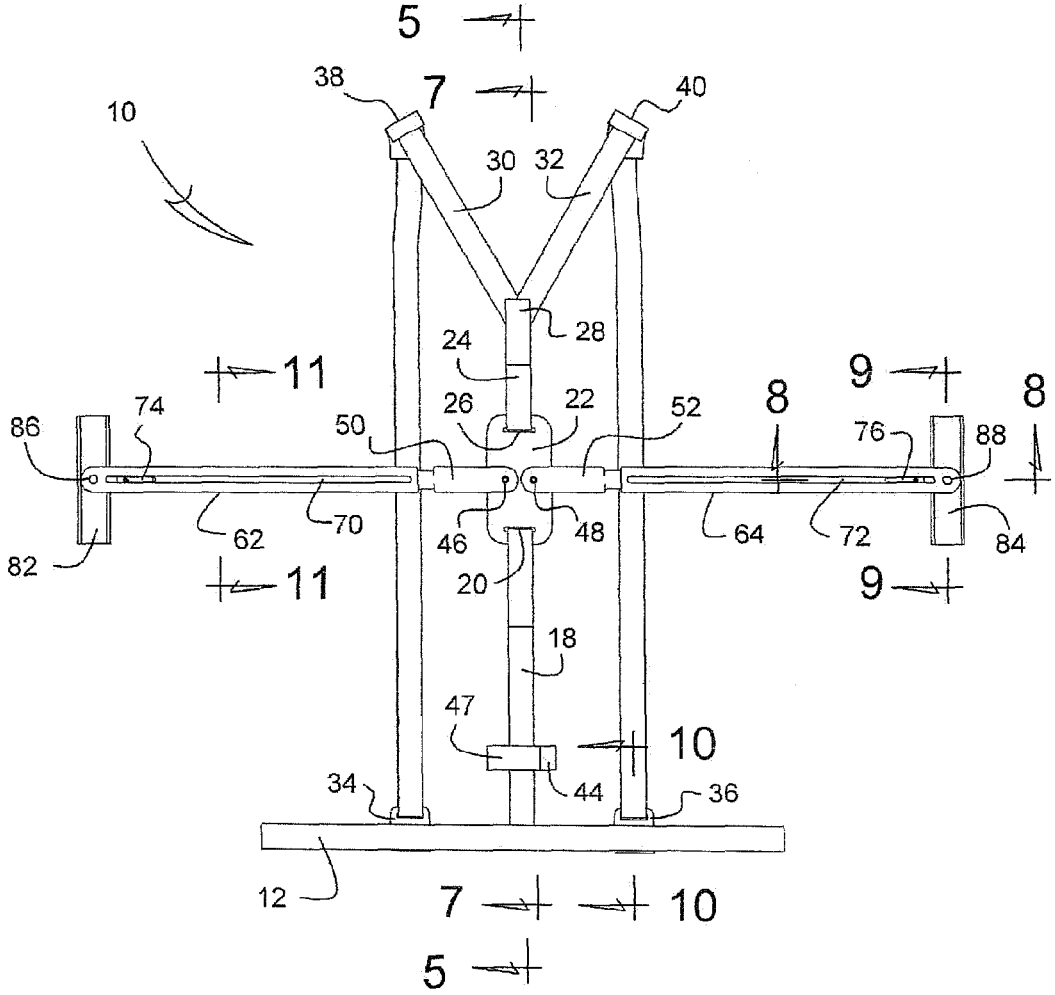
FIG. 2 is a rear view of the training harness of FIG. 1.

As is further illustrated in the rear view of FIG. 2, when viewed in combination with the perspective of FIG. 1, the assembly 10 includes a looped belt 12 adapted to be worn about a waist of a wearer and which further includes a pair of attachable (e.g. hook and loop) fastener portions 14 and 16, this including but not limited to such as Velcro® or other suitable and easy inter-engageable portions. An upwardly extending suspender includes a first portion 18 extending from a rear midpoint of the belt 12 and which terminates at an upper end engaging a planar (generally rectangular shaped) support portion 22. The support portion can include such as a rigid plate 22 (also termed a pivot panel) exhibiting a padded inner surface (see at 23 in rotated front view of FIG. 15) which abuts the mid-rear location of the wearers back (again FIG. 1) and which in use provides a fixed inner locations associated with the pivotal linkages for preventing forward arm movement.

A further flexible length 24 extends from a lower end 26 connected to an upper location of the rigid support portion 22 (and which includes both lower 25 and upper 27 slots (see FIG. 6) for receiving the opposing ends 20 and 26). An upper terminating end 28 of the upper extending flexible length 24 branches into pair of second suspender portions 30 and 32 and which are adapted to extend over shoulder locations of the wearer (FIG. 1) and connect at opposite lower ends 34 and 36 to forward locations of the belt 12.

The belt 12, suspender portions 18 and 24, and suspender portions 30 and 32 can, without limitation, be constructed of any flexible and/or elastic material such as a fabric or rubberized material exhibiting elastic properties. It is also envisioned that hybrid or composite materials could be employed which provide some combination of properties.

Figure 15:
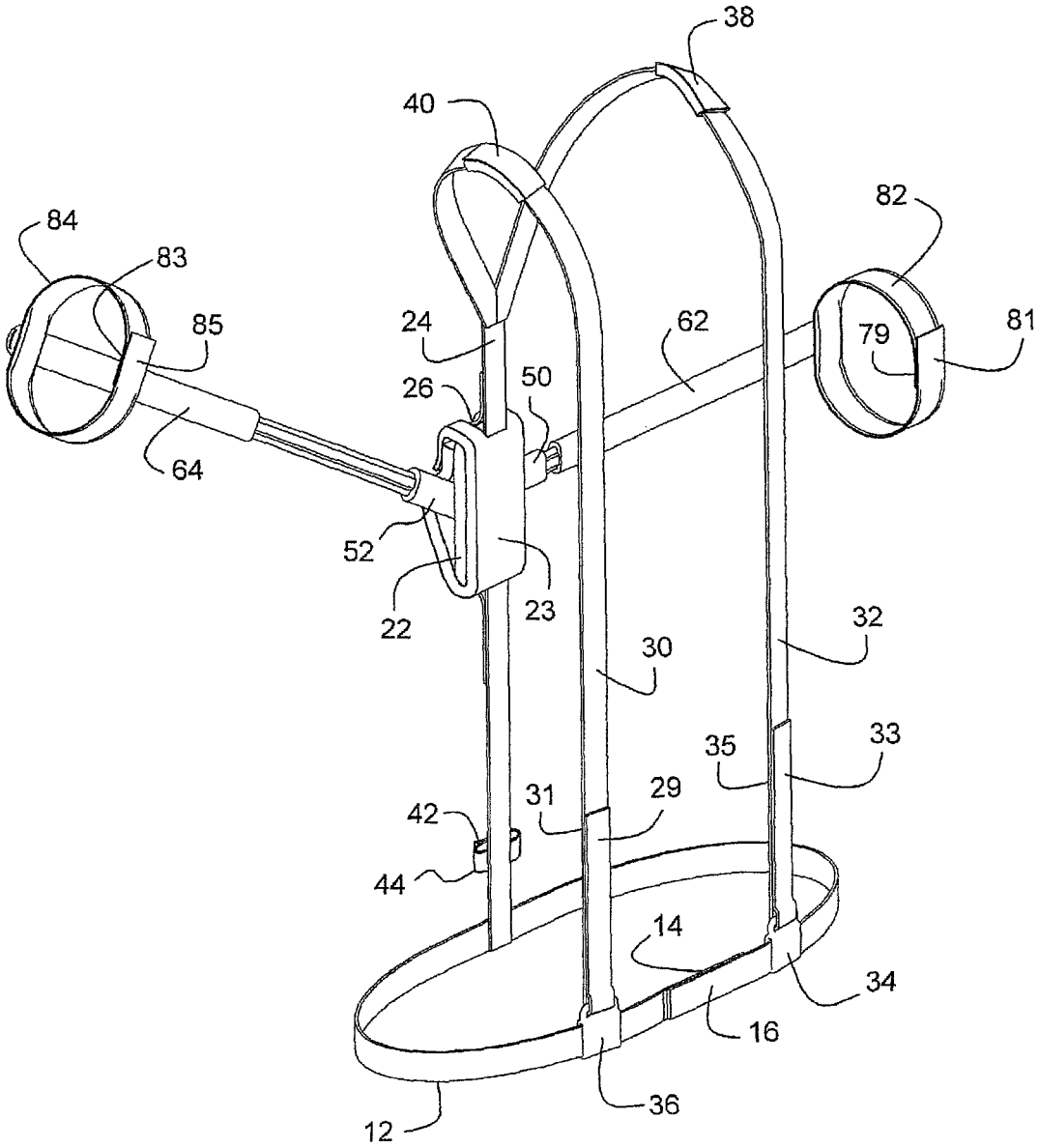
FIG. 15 is a front plan view of the training harness and better illustrating the features of the cushioning layer associated with the rigid support plate.
Figure 16:
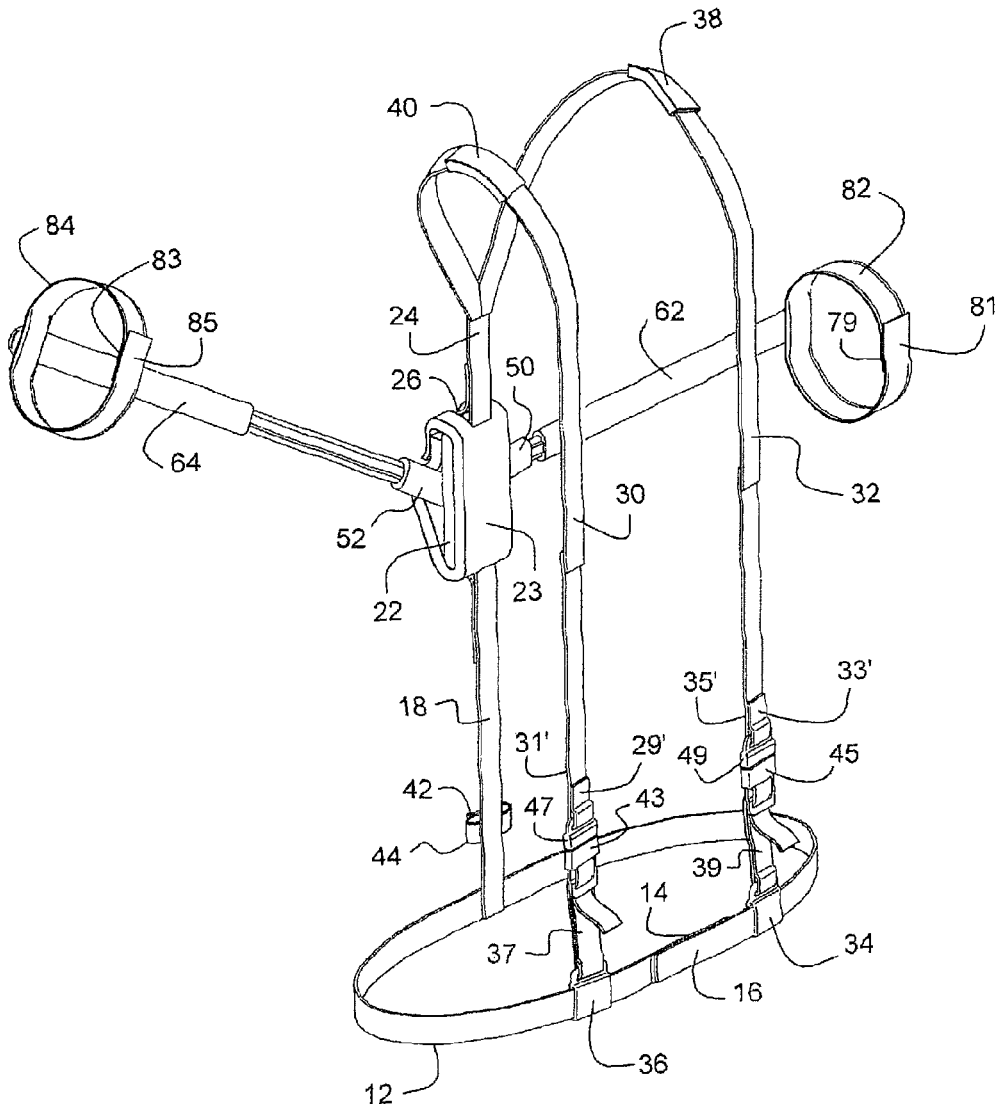
FIG. 16 is an illustration similar to FIG. 15 and further depicting additional elastic portions integrated into the front belt connecting locations of the first and second branching portions of the shoulder strap, this further including snap buckle locations for permitting a degree of length adjustability.

The suspender portions 30 and 32 each include length adjustment strap ends 29 & 31 and 33 and 35, respectively, as best shown in FIG. 15 and which are located proximate to the belt 12. Alternately, and as shown in the further modified scheme of FIG. 16, additional elastic portions 37 and 39 are integrated into the front belt connecting locations of the first and second branching portions of the shoulder strap. The ends of the additional elastic portions 37 and 39 extending from the forward belt locations further exhibit snap buckle engaging portions, see at 43 and 45, which engage with additional buckle receiving portions 47 and 49 extending from intermediate ends of modified straps 29' & 31' and 33' & 35', these as shown in FIG. 16 for permitting a degree of length adjustability. Cushioning shoulder straps are further depicted at 38 and 40 associated with intermediate locations of the upper second pair of suspender portions 30 and 32, with an additional band extending from lateral edges of the first rear suspender portion 18 at a location proximate the belt 12, these terminating in hook and loop fastener portions 42 and 44.

A pair of elongate and telescopically extensible linkages, typically constructed of metallic or hard plastic construction, are provided and which are pivotally supported to pin mounted locations 46 and 48 (such as including end attachable wing nuts or the like) associated with the rear suspender located planar rigid support 22. The linkages, as best depicted in exploded fashion in FIG. 6, each define a pair of first and second elongated and inter-telescoping portions and which is depicted by inner pivotally rotatable and elongated members 50 and 52 which include apertures 54 and 56 at inner-most ends which overlap with associated apertures 58 and 60 defined in the rigid support 22 (see FIG. 6) for receiving the pivotal supporting pins 46 and 48.

A pair of second elongated and outer telescoping members 62 and 64 include interiorly accessible and slotted inner ends 66 and 68 (again FIG. 6) which receive the inner members 50 and 52 in linearly insertable fashion. The outer telescoping members 62 and 64 further exhibit elongated slots or channels 70 and 72 defined there-along and through which project sliding pins 74 and 76 associated with terminating end locations 78 and 80 of the inner telescoping members and in order to telescopically support the outer members 62 and 64 relative to the inner members 50 and 52.

Figure 6:
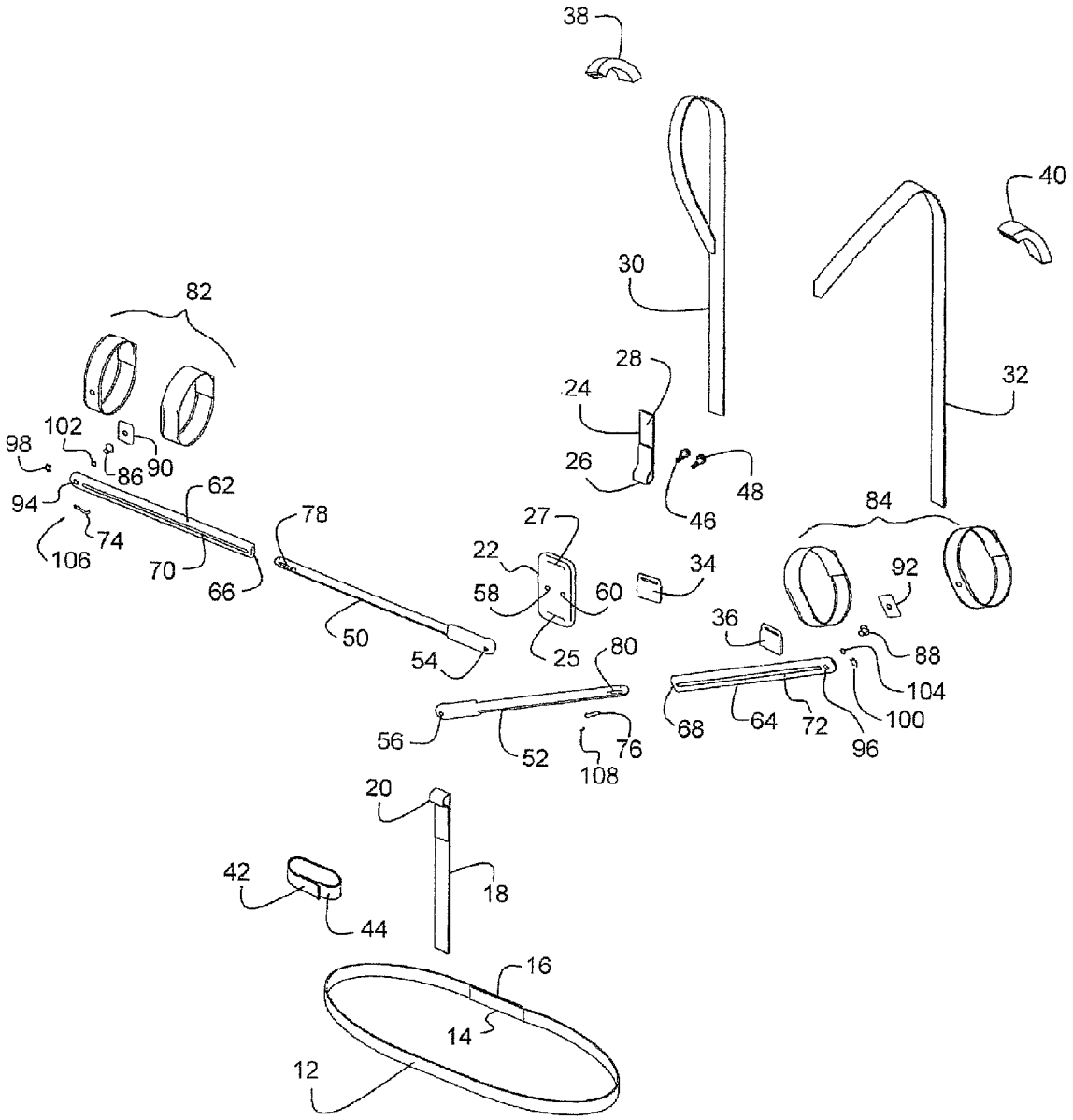
FIG. 6 is an exploded view of the harness assembly.
Figure 7:
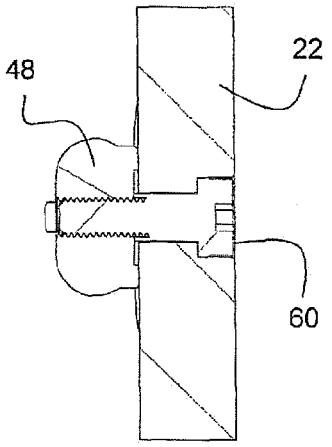
FIG. 7 is a cutaway view taken along line 7-7 of FIG. 2 and better depicting a selected pivotal linkage connection associated with a rear central support.
Figure 8:
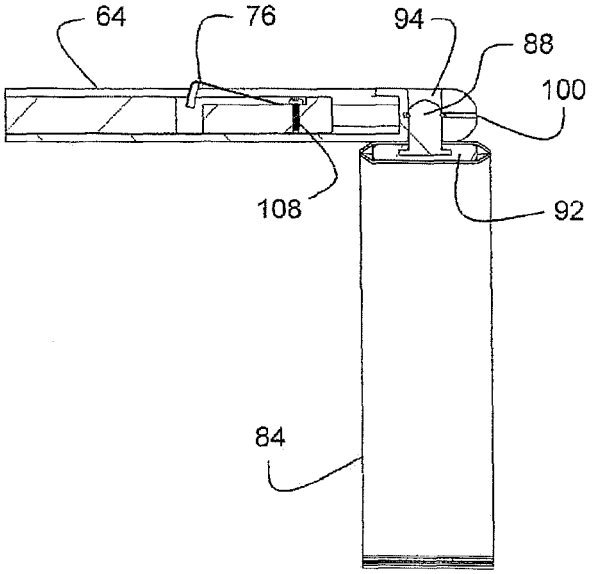
FIG. 8 is a longitudinal cutaway view taken along line 8-8 of FIG. 2 and better depicting an outer adjustable section of a selected linkage and arm supporting loop associated with the training harness.
Figure 9:
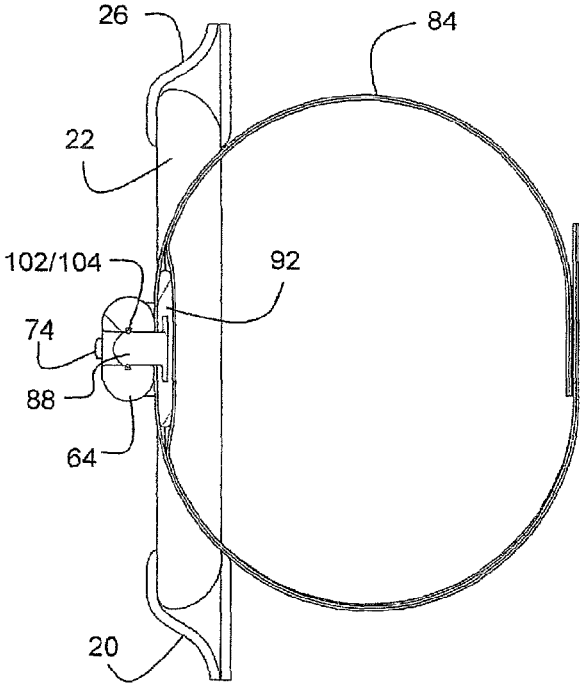
FIG. 9 is a height-wise cutaway taken along line 9-9 of FIG. 2 of the arm supporting loop in FIG. 8.
Figure 10:
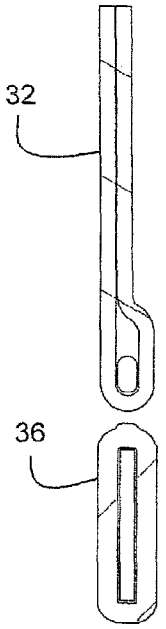
FIG. 10 is a cutaway view taken along line 10-10 of FIG. 2 and better showing a buckle connection between the belt loop and selected suspender.
Figure 11:
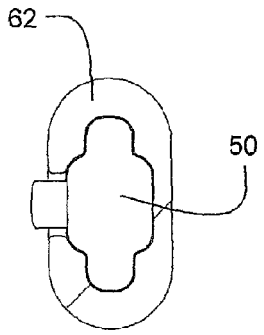
FIG. 11 is a cutaway view taken along line 11-11 of FIG. 2 of a midpoint telescoping location of a further selected linkage assembly.

A pair of circular bands including end disposed hook and loop fasteners are depicted at 82 and 84 (in FIG. 6 these are further depicted as either overlapping or otherwise spaced apart pairs of outer and inner bands with the further understanding that a single hook and loop extending band can be reconfigured for each of 82 and 84). As best shown in rotated front plan view of FIG. 15, arm bands 82 and 84 can each include additional hook and loop adjustable portions (see as respectively shown at 79 & 81 for band 82 and further at 83 and 85 for band 84) in order to adjust the circumference thereof to fit variously sized users. As shown, varying numbers of arm retainers can be stacked at the pivot locations, with the ends retained together by the headed retainer pin positioned through the corresponding slot of the adjacent arm retainer.

The bands 82 and 84 are dimensioned to be worn about the arms of the wearer (see again FIG. 1) and are pivotally secured to remote extending ends of outer linkage members 62 and 64. This further includes pins 86 and 88 and associated mounting supports 90 and 92 (again FIG. 6) extending from edge locations of the arm bands 82 and 84 and which are received through end mounted apertures 94 and 96 associated with the outer telescoping linkage members 62 and 64 such that the outer telescoping members are each pivotally connected to the arm bands at outer ends, combined with the inner supporting linkage members 50 and 52 being pivotally connected to the suspender incorporated rigid support 22. Additional fasteners are generally referenced at 98-104 in FIG. 6 and generally reference components which secure the outer arm bands 82 and 84 pivotally to the linkage assemblies in the manner shown in FIG. 6, with additional fasteners 106 and 108 assisting in the connection of the telescoping pins 74 and 76.

Additional features associated with the wearable training harness include the ability to adjusts the length of each of the belt 12, rear suspender 18 and branching forward suspenders 30 and 32. The linkage assemblies can each further include a set of varying dimensioned inner portions (such as depicted at 50 and 52) and which accommodate varying arm lengths of the wearer. Such linkage members can each exhibit an overall cross sectional thickness decreasing in dimension between inner pivotal and outer linkage end locations. The arm bands are further easily removable and replaceable based upon the physiological dimensions of the wearer.

Having described my invention, other and additional preferred embodiments will become apparent to those skilled in the art to which it pertains, and without deviating from the scope of the appended claims.

I claim:

1. A wearable training harness, comprising:

a looped belt adapted to be worn about a waist of a wearer;

an upwardly extending suspender including a first portion extending from a rear midpoint of said belt, a pair of second portions branching from said first portion and adapted to extend over shoulder locations of the wearer, said second portions connecting at opposite lower ends to forward locations of said belt; and a pair of elongate linkages pivotally secured to a rigid planar member supported at a location associated with said first suspender portion, such that said rigid planar member is adapted to overlay a mid-location of the wearer's back, said elongated linkages each further including a first linkage member pivotally secured at a first end to said rigid planar member, second linkage members telescoping relative to said first linkage members, with extending ends of said second linkage members being pivotally secured to each of a pair of circular arm bands adapted to be worn about the arms of the wearer so that said elongate linkages are both pivotal and telescoping in response to movement of the wearer's arms and in order to define a controlled range of permitted motion to train against the commitment of reach-in fouls.

2. The training harness as described in claim 1, further comprising cushioning shoulder pads associated with uppermost extending locations of said second suspender portions.

3. The training harness as described in claim 1, further comprising each of said belt, first suspender portion, second pair of suspender portions, and arm bands each being length adjustable.

4. The training harness as described in claim 1, further hook and loop fasteners extending from a lower location of said first suspender portion for capturing said linkages during storage.

5. The training harness as described in claim 1, further comprising elongated slots defined along each of said outer linkage members, sliding pins extending from end locations of said inner linkage members through said slots for defining an extensible range for said linkages.

6. The training harness as described in claim 1, further comprising elastic portions integrated into said second portions proximate said forward locations of said belt, snap buckle engaging portions mating with additional buckle receiving portions extending from opposing intermediate ends of said suspender second portions for permitting a degree of length adjustability.

7. A wearable training harness, comprising:

a looped belt adapted to be worn about a waist of a wearer;

an upwardly extending suspender including a first portion extending from a rear midpoint of said belt, a pair of second portions branching from said first portion and adapted to extend over shoulder locations of the wearer, said second portions connecting at opposite lower ends to forward locations of said belt;

a pair of telescoping and elongate linkages pivotally secured to a rigid planar member supported at a location associated with said first suspender portion, such that said rigid planar member is adapted to overlay a mid-location of the wearer's back;

a pair of circular bands adapted to be worn about the arms of the wearer, said bands pivotally secured to remote extending ends of said telescoping linkages; and said linkages each further comprising first linkage member pivotally secured at a first end to said rigid planar member, a second linkage member being telescopically received over an end of each of said first linkage members with extending ends of said second linkage members being pivotally secured to each of said arm bands and, in response to movement of the wearer's arms, defining a controlled range of permitted motion to train against the commitment of reach-in fouls.

8. The training harness as described in claim 7, further comprising cushioning shoulder pads associated with uppermost extending locations of said second suspender portions.

9. The training harness as described in claim 7, further comprising each of said belt, first suspender portion, second pair of suspender portions, and arm bands each being length adjustable.

10. The training harness as described in claim 7, further hook and loop fasteners extending from a lower location of said first suspender portion for capturing said linkages during storage.

11. The training harness as described in claim 7, further comprising elongated slots defined along each of said outer linkage members, sliding pins extending from end locations of said inner linkage members through said slots for defining an extensible range for said linkages.

12. The training harness as described in claim 7, further comprising elastic portions integrated into said second portions proximate said forward locations of said belt, snap buckle engaging portions mating with additional buckle receiving portions extending from opposing intermediate ends of said suspender second portions for permitting a degree of length adjustability.

13. A wearable training harness, comprising:

a looped belt adapted to be worn about a waist of a wearer;

an upwardly extending suspender including a first portion extending from a rear midpoint of said belt, a pair of second portions branching from said first portion and adapted to extend over shoulder locations of the wearer, said second portions connecting at opposite lower ends to forward locations of said belt;

elastic portions integrated into said second portions proximate said forward locations of said belt, snap buckle engaging portions mating with additional buckle receiving portions extending from opposing intermediate ends of said suspender second portions for permitting a degree of length adjustability; and a pair of elongate and telescoping linkages pivotally secured to a rigid planar member supported at a location associated with said first suspender portion and which is adapted to overlay a midpoint location of the wearer's back, a pair of circular bands adapted to be worn about the arms of the wearer, said bands pivotally secured to remote extending ends of said telescoping linkages and, in response to movement of the wearer's arms, defining a controlled range of permitted motion to train against the commitment of reach-in fouls.

14. The training harness as described in claim 13, said linkages each further comprising an inner linkage member pivotally secured at a first end to said rigid planar member, an outer linkage member being telescopically received over an end of each of said first linkage member.

15. The training harness as described in claim 14, further comprising elongated slots defined along each of said outer linkage members, sliding pins extending from end locations of said inner linkage members through said slots for defining an extensible range for said linkages.

16. The training harness as described in claim 13, further comprising cushioning shoulder pads associated with uppermost extending locations of said second suspender portions.

17. The training harness as described in claim 13, further comprising each of said belt, first suspender portion, second pair of suspender portions, and arm bands each being length adjustable.

18. The training harness as described in claim 13, further hook and loop fasteners extending from a lower location of said first suspender portion for capturing said linkages during storage.

19. The training harness as described in claim 13, further comprising an additional and crosswise extending band associated with a lower location of said first suspender portion and having first and second hook and loop fastener portions.

* * * * *